US006170712B1

(12) United States Patent
Kasboske

(10) Patent No.: US 6,170,712 B1
(45) **Date of Patent: *Jan. 9, 2001**

(54) CONTAINER FOR HOLDING AND DISPENSING NON-RIGID MATERIAL

(76) Inventor: George Kasboske, 2820 N. Whipple, Chicago, IL (US) 60618

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/862,985

(22) Filed: May 23, 1997

(51) Int. Cl.[7] ..... B65D 37/00
(52) U.S. Cl. ..... 222/215; 222/107
(58) Field of Search ..... 222/92, 107, 206, 222/215; 220/666, 669, 670, 671

(56) References Cited

U.S. PATENT DOCUMENTS

| | | | | |
|---|---|---|---|---|
| D. 184,021 | * | 12/1958 | Lerner . | |
| D. 246,155 | * | 10/1977 | Hoyt . | |
| 2,368,944 | * | 2/1945 | Parkhurst . | |
| 2,685,316 | | 8/1954 | Krasno . | |
| 3,156,383 | | 11/1964 | Melli . | |
| 3,162,371 | * | 12/1964 | Palmer et al. | 222/206 X |
| 3,395,836 | | 8/1968 | Stahmer . | |
| 3,727,803 | | 4/1973 | Cobb . | |
| 3,939,887 | | 2/1976 | Scarnato . | |
| 4,744,476 | | 5/1988 | McKee . | |
| 4,898,306 | * | 2/1990 | Pardes | 222/206 |
| 5,054,631 | * | 10/1991 | Robbins, III | 220/666 |
| 5,174,458 | | 12/1992 | Segati . | |
| 5,255,808 | | 10/1993 | Tobler . | |
| 5,609,899 | | 3/1997 | Spector . | |

FOREIGN PATENT DOCUMENTS

| | | | | |
|---|---|---|---|---|
| 1061296 | * | 8/1979 | (CA) | 222/215 |
| 798338 | * | 7/1958 | (GB) | 222/215 |

* cited by examiner

*Primary Examiner*—Joseph A. Kaufman
(74) *Attorney, Agent, or Firm*—Wood, Phillips, VanSanten, Clark & Mortimer

(57) ABSTRACT

A container for holding and facilitating dispensing of a substance. The container has a body with a peripheral wall defining a storage space for a substance and an opening in communication with the storage space to facilitate introduction of a substance into the storage space and dispensing of a substance from the storage space. The body has a top and bottom, a top wall, a bottom wall, and oppositely facing wall surfaces on the peripheral wall between the top and bottom of the body. There is a fold structure on the body that causes a part of the body to reposition in a predetermined manner relative to another part of the body as an incident of the captive force being exerted on the oppositely facing wall surfaces. The fold structure includes a fold line that extends substantially fully between the top and bottom of the body and over a substantial portion of the bottom wall.

15 Claims, 6 Drawing Sheets

CONTAINER FOR HOLDING AND DISPENSING NON-RIGID MATERIAL

BACKGROUND OF THE INVENTION

1. Field of the Invention

This invention relates to containers of the type used to hold non-rigid, pourable materials and, more particularly, to a container that can be reconfigured to facilitate the discharge of the materials therefrom.

2. Background Art

A myriad of different non-rigid, pourable substances are sold in containers for dispensing by an end user. Exemplary of such substances are toothpaste, consumable substances such as ketchup, honey, beverages, and the like, adhesives, lubricants, etc. A typical container for these substances will have a generally cylindrical body with a discharge opening over which a removable cap is placed.

Some such substances are held in containers having a substantially fixed configuration. For example, beverages are commonly sold in glass or metal containers. These containers must be inverted to allow gravitational flow of the substance through the discharge opening. While this type of container is suitable for most consumable beverages, there are problems associated with these containers when they are used to dispense more viscous substances.

For example, ketchup is offered by various manufacturers in both glass bottles and plastic "squeeze bottles". Most people have experienced problems in discharging ketchup from a glass bottle. Patrons in restaurants can frequently be seen pounding on the bottom of the inverted bottle or hitting the neck thereof to initiate discharge and ultimately choosing the unsanitary route and placing an eating utensil through the discharge opening to start the flow of the ketchup.

Aside from this problem is the problem of exhausting substantially the entirety of the substance from the glass container. When the user stores the glass containers with ketchup or salad dressing therein, the remaining amounts settle to the bottom of the container. Discharge involves inverting the bottle to cause the remaining substance to flow, often slowly, by gravity up to and out of the discharge opening. This is aggravated by the fact that the substance over long periods of time may lose moisture and solidify at the bottom of the container. This problem is often addressed by putting the cap over the container and storing the container on a flat surface, such as a countertop, in an inverted position until all of the substance migrates to the vicinity of the discharge opening. Alternatively, the consumer will avoid this inconvenience and discard the container with a significant amount of the usable substance still therein. While this may increase sales to a manufacturer, it is inefficient and often frustrating to a consumer.

Squeeze bottles obviate the above problems to a certain extent. A typical squeeze bottle will be made from a plastic material that is shape-retentive but deformable under a predetermined pressure to reduce the storage volume, increase the internal pressure, and cause an expulsion of the substance under pressure through the discharge opening. This type of container typically has a bottom wall with a large enough footprint to stably support the container in an upright, storage position. The bottom wall of the container is, by reason of its configuration, relatively rigid. The most conveniently squeezable portion of the container is the mid-portion thereof. In a full container, pressure at the mid-portion results in flow division, with the material above the mid-portion being forced toward the discharge opening and the substance below the mid-portion being urged toward the bottom of the container. As the substance is exhausted and the substance level is below the mid-portion, the user is required to reposition the substance above the mid-portion before squeezing. This may be accomplished by inverting the container for some time or by sharply thrusting the container so that the momentum of the substance causes it to reposition toward the upper region of the container. This is obviously inconvenient and often requires strength not possessed by a consumer. Thus, the squeezable container is likewise difficult to fully empty, potentially leading to significant amounts of waste.

A further problem with a squeezable container is that the material may not have the resilience to re-assume an undeformed state after it is squeezed. This may be aggravated over time as the material loses its initial resilience. Further, the user may have a tendency to exert an excessive squeezing pressure on the container, particularly when the quantity of the substance is relatively small. In a worst case, this could lead to a rupture of the container, most commonly at a molding seam.

It is also known to use non-shape-retentive containers to dispense substances. For example, toothpaste is commonly placed in a tube that can be rolled from the bottom end to force the paste up toward the discharge opening where it can be easily squeezed out. While this is an effective way of facilitating substance discharge, ofttimes this makes product identity difficult. An important feature of most every container is the ability to present to the supplier and/or manufacturer an opportunity to place their identity on the product which remains through its useful life. Used toothpaste tubes commonly become a wrinkled, unappealing mass. At some point, the advertising material on the container becomes completely obliterated. Product identification for purposes of reordering may be made difficult or impossible.

While the obscuring of the product or supplier/manufacturer identity may be nothing more than a marketing problem in the aftermarket, sometimes these containers include directions or warnings that are important for safe use thereof. The user may be deprived of this information, which could result in an improper and, in a worst case, dangerous use of a product.

Generally, both of the squeezable and deformable containers, described above, may be difficult or inconvenient to use for someone with limited strength or a handicap, such as arthritis.

Another problem with squeezable containers is that often the quality of the substance discharge is compromised. For example, a substance such as ketchup may separate, with the solid particles in the solution migrating downwardly, leaving primarily liquid at the top. By squeezing the mid-portion, initially the liquid will be discharged. While this problem could be alleviated by shaking and pre-mixing the substance in the container, this may not be a common practice for the consumer.

Still other substances may be made of multiple components which tend to naturally separate under gravitational force. By squeezing the container at the mid-portion, lighter components are pressed upwardly for discharge while heavier components may be squeezed even further to the bottom of the container.

SUMMARY OF THE INVENTION

In one form of the invention, a container is provided for holding and facilitating dispensing of a substance. The container has a body with a peripheral wall defining a storage space for a substance and an opening in communication with the storage space to facilitate introduction of a substance into the storage space and dispensing of a substance from the storage space. The body has a top and bottom, a top wall, a bottom wall, and oppositely facing wall surfaces on the peripheral wall between the top and bottom of the body. There is a fold structure on the body that causes a part of the body to reposition in a predetermined manner relative to another part of the body as an incident of a captive force being exerted on the oppositely facing wall surfaces. The fold structure includes a fold line that extends substantially fully between the top and bottom of the body and over a substantial portion of the bottom wall.

A cap can be removably connected to the body to selectively block the body opening.

In one form, the peripheral wall has a circumference and the fold line has first and second portions that are spaced from each other around the circumference of the body and extending over the bottom wall substantially fully between the first and second portions.

The fold line may extend over at least a part of the top wall of the body.

The fold structure may be made up of accordion folds having a length extending in a direction between the top and bottom of the body.

In one form, the peripheral wall has an outer surface that has at least one of a) a cylindrical outline, b) an elliptical outline, and 3) an oval outline in cross-section.

The accordion folds may reside within the outline of the peripheral wall or extend outwardly therefrom.

The body may be made from a shape retentive material. The body has an undeformed state and a deformed state in which the body is in with a predetermined captive force applied. The body substantially assumes the undeformed state after the predetermined captive force is removed.

The body may be formed as one piece.

In another form of the invention, a container is provided for holding and facilitating dispensing of a substance. The container has a body with a peripheral wall defining a storage space for a substance and an opening in communication with the storage space to facilitate introduction of a substance into the storage space and dispensing of the substance from the storage space. The body has a top and bottom, a top wall, a bottom wall, a front wall and a rear wall facing oppositely to the front wall. Structure is provided on the body for causing the body to reconfigure in a predetermined manner as an incident of the front and rear walls being moved towards and away from each other. The structure may include a plurality of accordion folds on the bottom wall of the container.

The structure may include non-straight folds that extend around the opening.

The structure may further include accordion folds on the top wall of the body.

The structure may include accordion folds extending between the top and the bottom of the body.

In one form, the peripheral wall has a circumference, with the accordion folds at first and second locations spaced around the circumference of the peripheral wall and each having a length extending between the top and bottom of the container.

The accordion folds on the bottom wall may extend continuously between the according folds at the first and second locations.

In one form, the bottom wall has an area and the accordion folds on the bottom wall extend over substantially the entire area of the bottom wall.

In another form of the invention, a container is provided for holding and facilitating dispensing of a substance. The container has a body with a peripheral wall defining a storage space for a substance and an opening in communication with the storage space to facilitate introduction of a substance into the storage space and dispensing of a substance from the storage space. The body has top and bottom and an outer wall with oppositely facing wall surfaces between the top and bottom of the body. A fold line has a first portion that extends between the top and bottom of the body and causes a part of the body to reposition in a predetermined manner relative to another part of the body as an incident of a captive force being exerted on the oppositely facing wall surfaces. The peripheral wall has a first circumference with the outer wall having a second circumference. The circumference of the outer wall may be substantially greater than the circumference of the peripheral wall.

The folds may extend over each of the top and bottom walls continuously between the first and second locations on the peripheral wall. The body opening may be offset from the folds.

DETAILED DESCRIPTION OF THE DRAWINGS

Figure 1:
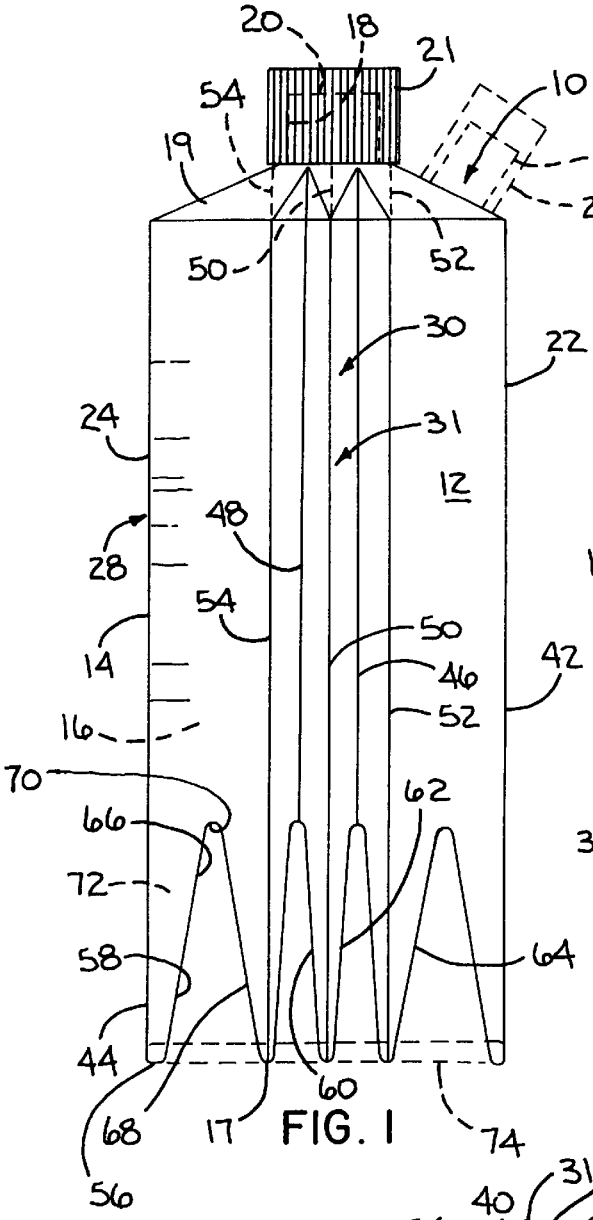
FIG. 1 is a side elevation view of one form of container, according to the present invention.
Figure 2:
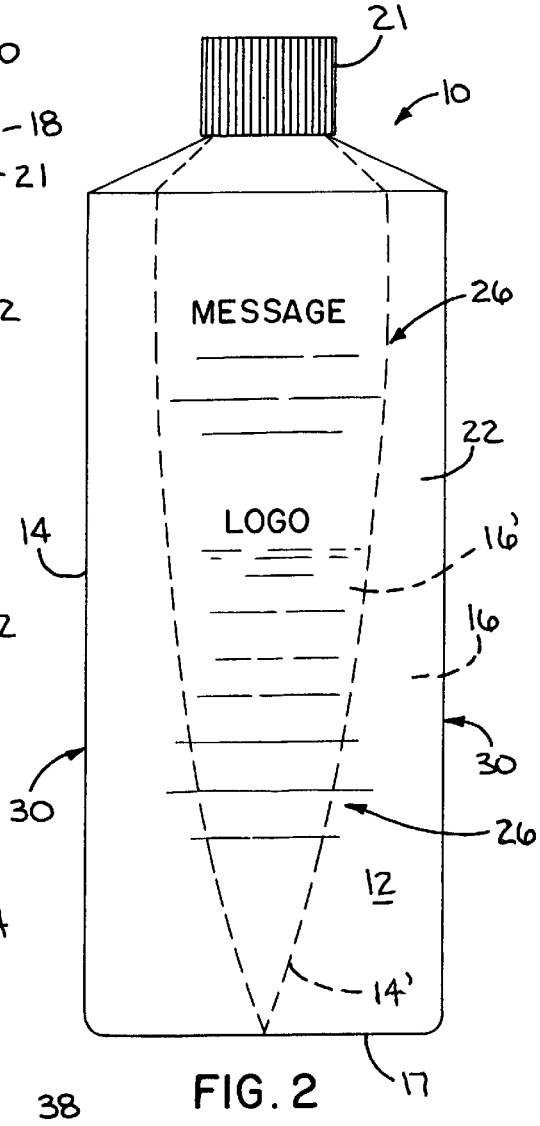
FIG. 2 is a front elevation view of the container in FIG. 1.
Figure 3:
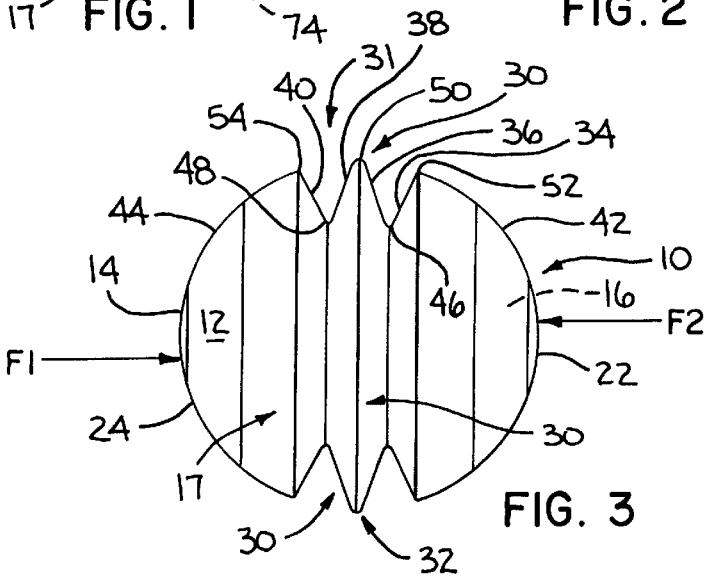
FIG. 3 is a bottom view of the container in FIGS. 1 and 2.

In FIGS. 1–3, a first form of container, according to the present invention, is shown as 10. The container 10 has a body 12 with a peripheral wall 14 defining a storage space 16 for a substance and a bottom wall 17 for supporting the container 10 in an upright position on a subjacent support surface. The precise substance that is placed in the container 10 is irrelevant to the invention. The substance is preferably a non-rigid, pourable substance that is conventionally caused to be dispensed from a container, such as toothpaste, edible products such as ketchup and salad dressing, oils, adhesives, caulking, shampoos, creams, gels, and the like. A reduced diameter neck 18 is provided on a top wall 19 of the container 10 and defines an opening 20 in communication with the storage space 16 to facilitate introduction of a substance into the storage space 16 and dispensing of the substance from the storage space 16. A cap 21 is removably connected to the neck 18, as through cooperating threads, to selectively block the opening 20.

The peripheral wall 14 has oppositely facing first and second wall surfaces 22, 24 extending substantially fully between the top and bottom of the container 10. The first wall surface 22 is viewable in elevation as seen in FIG. 2. The second wall surface 24 is viewable by turning the body 12 through 180° around a vertically extending center line (VCL) from the FIG. 2 position. The wall surface 22 at the front of the container 10 has a substantial area to accommodate written materials or logos shown generically at 26. The written material may include a description of the contents of the container 10, cautionary material, directions for use, etc. The wall surface 24 at the rear of the container 10 may bear similar messages or logos, as shown generally at 28.

Fold structure 30 is provided, with portions 31, 32 thereof at diametrically opposite locations on the container 10. The third wall surface is viewable in elevation in FIG. 1 with the fourth wall surface viewable by turning the body 12 through 180° around the vertically extending center line. A horizontal center line (CL—one shown) for each of the third and fourth wall surfaces is located between the first and second wall surfaces 22, 24. The first, second, third and fourth wall surfaces are viewable in succession by rotating the body 12 around the vertically extending center line (VCL). The portions 31, 32 of the fold structure 30 are the same, with the exemplary fold structure portion 31 being defined by a zigzag pattern of flat wall parts 34, 36, 38, 40 which produce accordion folds. The third and fourth wall surfaces have a width dimension (W). The accordion wall surfaces occupy substantially less than the width dimension for each of the third and fourth wall surfaces.

By exerting a captive force, such as through the application of forces F1, F2 in Opposite directions on the wall surfaces 22, 24, the wall parts 42, 44 defining the wall surfaces 22, 24, are caused to reposition in a predetermined manner relative to each other. As the forces F1, F2 are applied, the wall parts 34, 36 fold against each other about a fold line 46, with the wall parts 38, 40 folding against each other in a similar fashion about a fold line 48. The wall parts 36, 38 fold relative to each other about a fold line 50, with the wall parts 34 and 40 folding relative to the wall parts 42, 44, respectively, about fold lines 52, 54. Through this folding action, the effective volume of the storage space 16 is reduced, thereby causing the substance in the container 10 to be expelled under pressure through the opening 20.

In this particular embodiment, the fold lines 46, 48, 50, 52, 54 extend fully from the bottom edge 56 of the container 10 to the neck 18. The invention contemplates that the fold lines 46, 48, 50, 52, 54 could extend less than the entire height of the container 10. Further, the fold lines 46, 48, 50, 52, 54 extend over the bottom wall 17 fully between the fold structure portions 31, 32.

With this arrangement, the curved wall parts 42, 44 maintain their shape and relative position as the forces F1, F2 are applied thereto. Typically, the forces F1, F2 are applied by grasping the container in the user's hand and using the fingers to draw the container compressibly into the palm to effect expulsion of the substance in the container 10. Preferably, the body 12 is made in one piece from a plastic or other shape-retentive material that will deform as described above and reassume an undeformed state after the forces F1, F2 are removed.

Accordingly, the surfaces 22, 24 may remain substantially undeformed through the life of the container 10. As a result, the message/logos 26, 28 thereon remain intact as a convenience to the user and for product identity. At the same time, the expulsion of the substance is facilitated by the fold structure 30, 32, which also facilitates collapsing of the container to squeeze the contents therefrom.

Another feature of the present invention is the provision of V-shaped recesses 58, 60, 62, 64, with the recesses 60, 62 being formed by the fold structure 30 over the bottom wall 17. Exemplary recess 58 is bounded by wall parts 66, 68 which meet at a fold line 70. As the wall surface 24 at the bottom of the container 10 is pressed toward the wall surface 22, the wall part 66 moves against the wall part 68. This causes the wall part 24 to collapse inwardly toward the wall part 66, thereby collapsing the space 72 between the wall parts 44, 66 and thereby urging the substance upwardly beyond the recess 58. Accordingly, the recesses 58, 60, 62, 64 serve the dual purposes of a) reducing the volume of the storage space 16 for the contained substance at the bottom of the container 10 and b) facilitating squeezing of the substance from that part of the container 10 at the height of the recesses 58, 60, 62, 64. Accordingly, the substance at the bottom of the container 12 can be (conveniently squeezed upwardly in the container 10 for proper mixing with the remaining substance and expulsion through the opening 20. This is the same type of action that is commonly produced by squeezing a tube of toothpaste from the bottom thereof. This arrangement permits a relatively complete exhaustion of the container substance.

To increase the footprint of the container 10, an optional cap 74 can be provided on the bottom wall 17 of the container 10.

As shown in phantom in a variation in FIG. 2, the container need not be uniformly cylindrical along its entire height. In this case a peripheral wall 14' defining the storage space 16' can have a circumference less than that of the outer peripheral wall 14. This produces an exposed display area that is greater than that afforded by the circumference of the peripheral wall 14'. Purveyors can thus sell a relatively small quantity of substance with a greater display area than would normally be permissible by the peripheral wall 14' for better product promotion. In this embodiment, the size of the space 16' also decreases from top to bottom.

In another variation, the neck 18 and cap 21 can be offset as shown in phantom lines in FIG. 1. This allows the fold lines 46, 48, 50, 52, 54 to extend fully over the top wall 19, as shown also in phantom lines, so that the neck 18 does not interfere with the collapsing.

Figure 4:
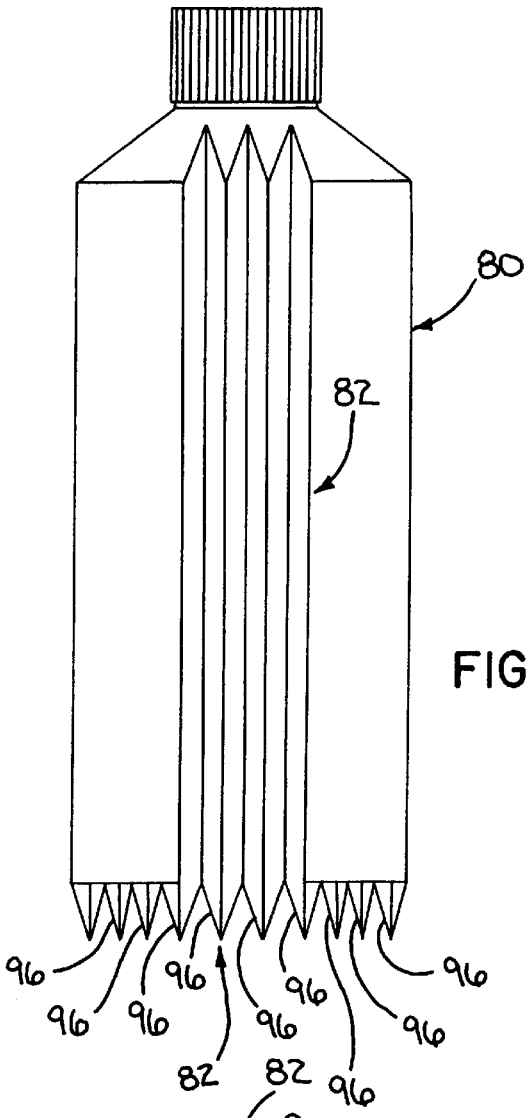
FIG. 4 is a side elevation view of a modified form of container, according to the present invention.
Figure 5:
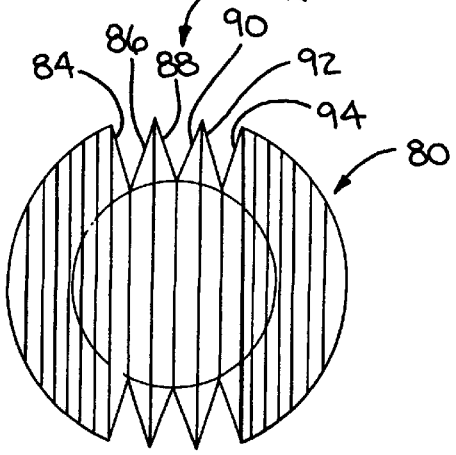
FIG. 5 is a bottom view of the container in FIG. 4.
Figure 6:
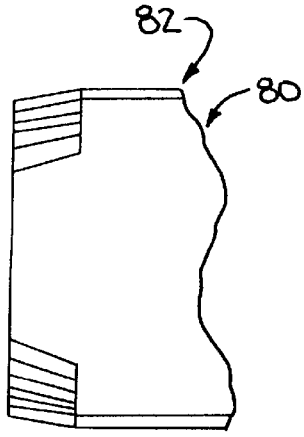
FIG. 6 is a fragmentary, front elevation view of the container in FIGS. 4 and 5.

In FIGS. 4–6, a modified form of container, according to the present invention, is shown at 80. The most significant difference between the container 80 and the container 10, previously described, is that the container 80 has a fold structure 82 with an accordion-type arrangement with six flat wall parts 84, 86, 88, 90, 92, 94 as compared to the corresponding five wall parts 34, 36, 38, 40, 42 on the container 10. Additionally, recesses 96 at the bottom of the container 80 have a shorter vertical extent than do the recesses 58, 60, 62, 64 in the container 10.

Figure 7:
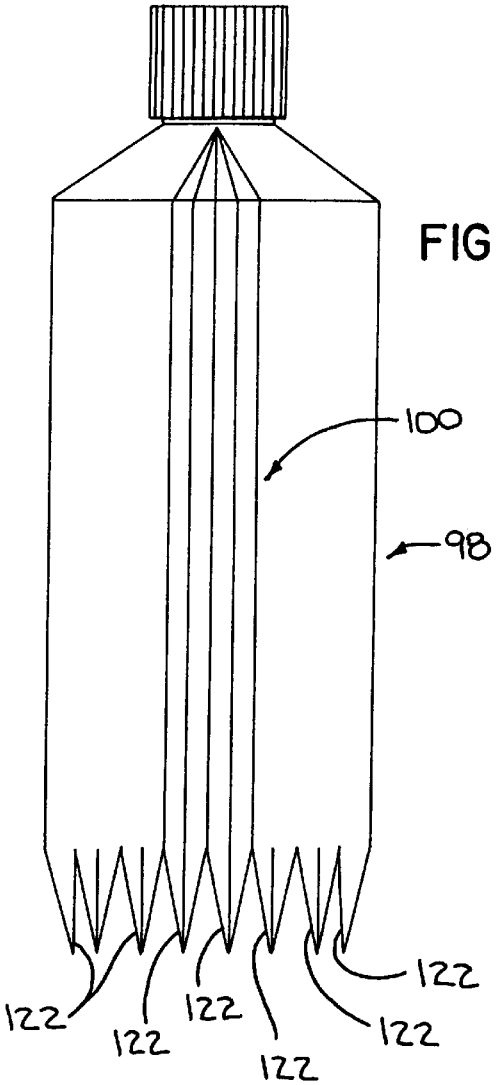
FIG. 7 is a side elevation view of a further modified form of container, according to the present invention.
Figure 8:
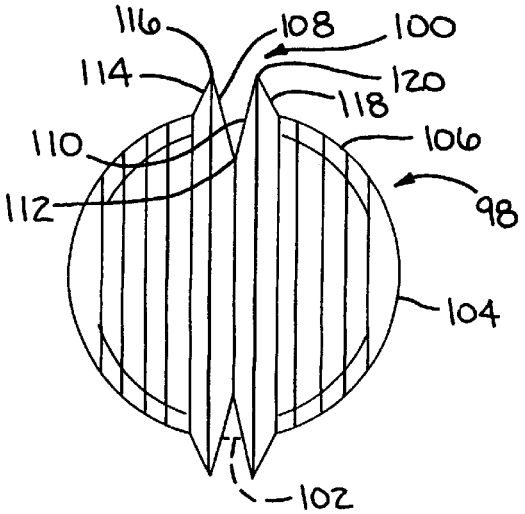
FIG. 8 is a bottom view of the container in FIG. 7.
Figure 9:
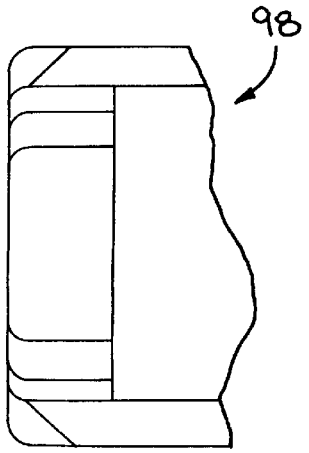
FIG. 9 is a fragmentary, front elevation view of the container in FIGS. 7 and 8.

Another modified form of container, according to the present invention, is shown at 98 in FIGS. 7–9. The container 98 is similar to the container 80, with the primary difference being that a part of the fold structure at 100 projects outwardly from the cylindrical outline 102 for the outer surface 104 of the peripheral wall 106. Wall parts 108, 110 are foldable relative to each other about a fold line 112. The wall part 108 is foldable relative to a shallower wall part 114 around a fold line 116. The wall part 110 is foldable relative to a shallower wall part 118 about a fold line 120.

The surfaces 108, 110, 114, 118 cooperatively define a conveniently grippable portion of the container 98 and also increase the storage capacity for the container 98 over that which the container 98 would have if the same type of fold structure 100 did not project outside of the container outline 102.

The recesses 122 at the bottom of the container 98 have a vertical extent that is greater than that for the recesses 96 on the container 80 and less than that for the recesses 58, 60, 62, 64 for the container 10.

Figure 10:
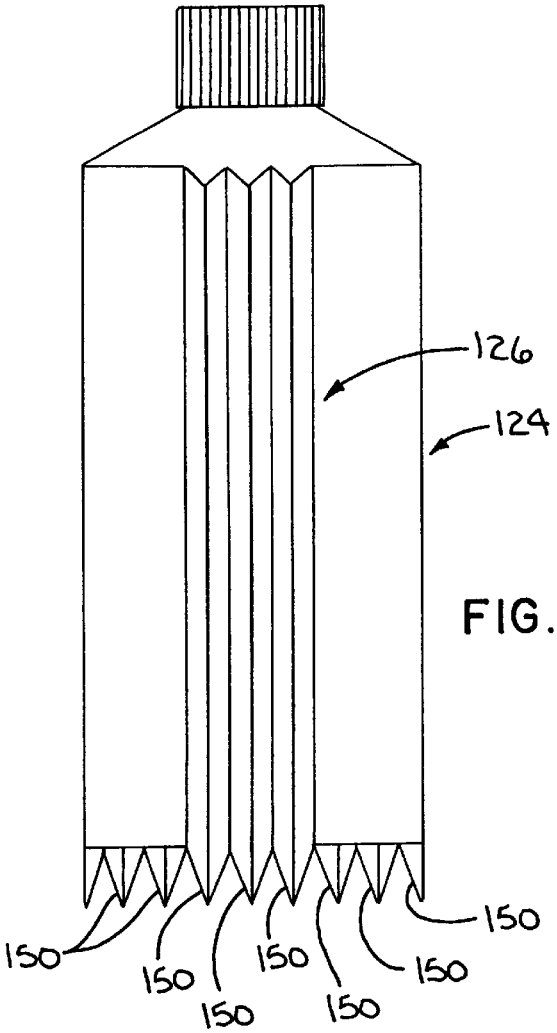
FIG. 10 is a side elevation view of a further modified form of the container, according to the present invention.
Figure 11:
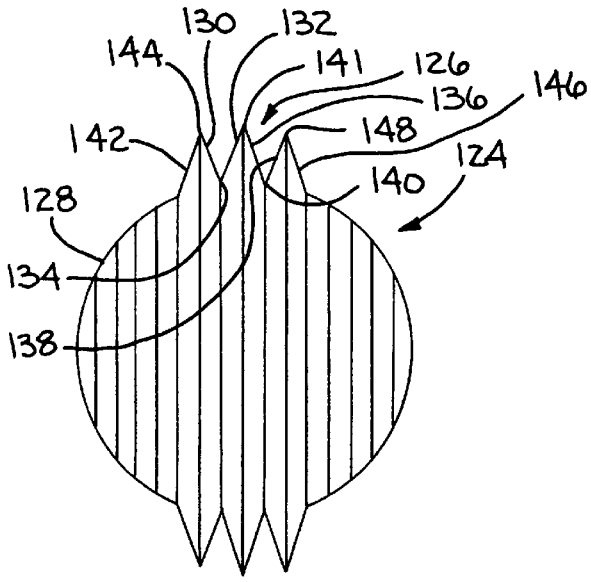
FIG. 11 is a bottom view of the container in FIG. 10.
Figure 12:
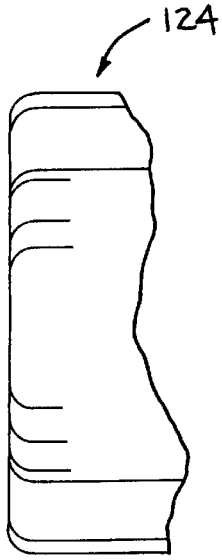
FIG. 12 is a fragmentary, front elevation view of the container in FIGS. 10 and 11.

A further modified form of container, according to the present invention, is shown at 124 in FIGS. 10–12. The container 124 is similar to the container 98, with the primary difference being that the fold structure 126 does not project to within the container outline 128. Whereas the container 98 has two wall parts 108, 110 that are foldable against each other, the fold structure 126 has a first pair of wall parts 130, 132 that are foldable towards each other about a fold line 134 and a second pair of wall parts 136, 138 that are foldable against each other about a fold line 140. The wall parts 132, 136 are foldable relative to each other about a fold line 141. The wall part 130 is foldable relative to a wall part 142 about a fold line 144, with the wall part 138 being is foldable relative to a wall part 146 about a fold line 148. With this arrangement, the capacity of the container 124 is increased by an amount equal to the space bounded by the wall parts 130, 132, 136, 138, 142, 146 outside of the container outline 128. Recesses 150 at the bottom of the container 124 have a vertical extent on the order of that for the recesses 96 on the container 80.

Figure 13:
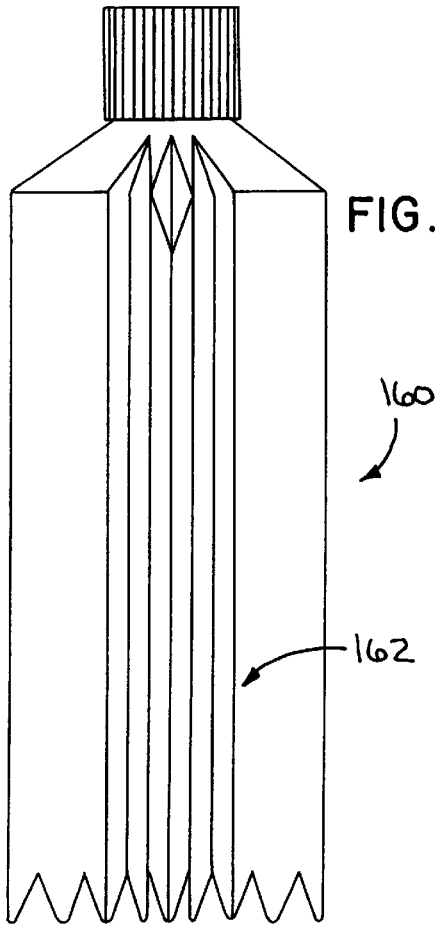
FIG. 13 is a side elevation view of a further modified form of container, according to the present invention.
Figure 14:
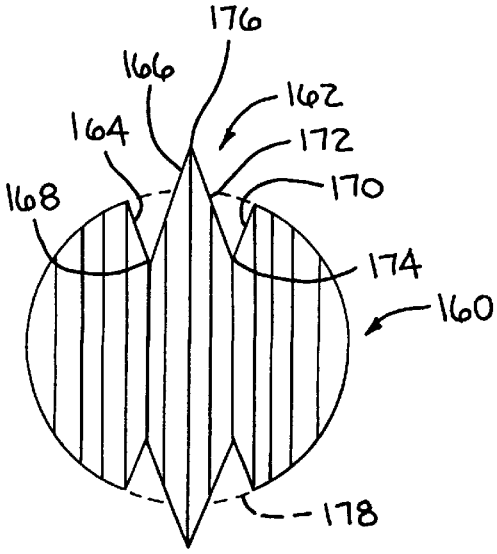
FIG. 14 is a bottom view of the container in FIG. 13.
Figure 15:
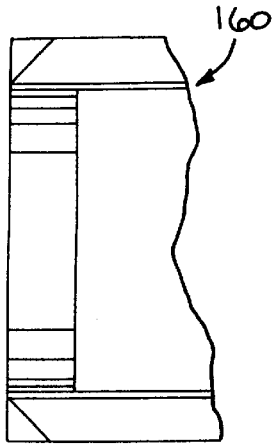
FIG. 15 is a fragmentary, front elevation view of the container in FIGS. 13 and 14.

A further modified form of container, according to the present invention is shown at 160 in FIGS. 13–15. The container 160 has a fold structure 162 having features of the fold structures 30, 82, 100, 126 on the containers 10, 80, 98, 124. The fold structure 162 has shallow and deep wall parts 164, 166 which are foldable relative to each other about a fold line 168 and shallow and deep wall parts 170, 172 foldable relative to each other about a fold line 174. The wall parts 166, 172 are foldable relative to each other about a fold line 176. A certain amount of the volume reduction resulting from the projection of the surfaces 164, 166, 170, 172 to within the container outline 178 is compensated for by the projection of the wall parts 166, 172 outside of the container outline 178.

Figure 16:
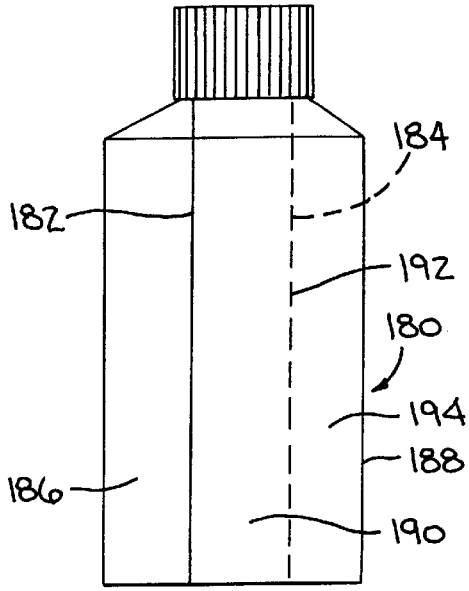
FIG. 16 an elevation view of a still further modified form of container, according to the present invention.

In FIG. 16, a further modified form of container, according to the present invention, is shown at 180. The container 180 has first and second fold lines 182, 184. The fold line 182 allows one part 186 of a peripheral wall 188 to be folded in a predetermined manner relative to another part 190 of the peripheral wall 188. In this case, the fold line 182 is defined by scoring which produces a weakening, so that the fold line 182 acts as a hinge. The fold line 182 can extend to a diametrically opposite location on the container 180.

The fold line 184 has spaced weakening lines 192 which cause a part 194 of the peripheral wall 188 to fold in a predetermined fashion relative to the wall part 190. The fold line 192 can likewise extend to a diametrically opposite location on the container 180.

Figure 17:
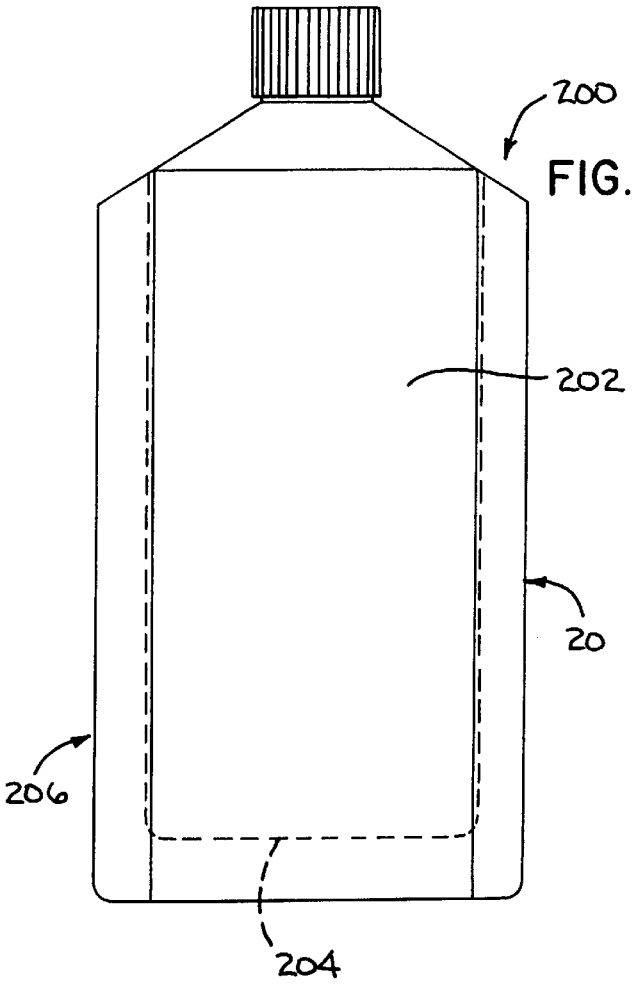
FIG. 17 is an elevation view of a still further modified form of invention, according to the present invention.

In FIG. 17 a modified form of container, according to the present invention, is shown at 200. The container 200 has a substantially flat front wall 202 and rear wall (not shown) to provide a substantial usable area for writing and/or a logo, which may be applied thereto through a label 204 that can be suitably attached, as by an adhesive. The container 200 has fold structure 206 at diametrically opposite sides thereof. In cross-section, the container 200 has either an oval or a square shape.

Figure 18:
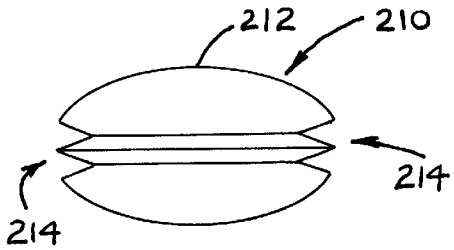
FIG. 18 is a bottom view of a still further form of container, according to the present invention.

In FIG. 18 a further modified form container, according to the present invention, is shown at 210, and has a generally oval body 212 with fold structure 214 at its sides.

Figure 19:
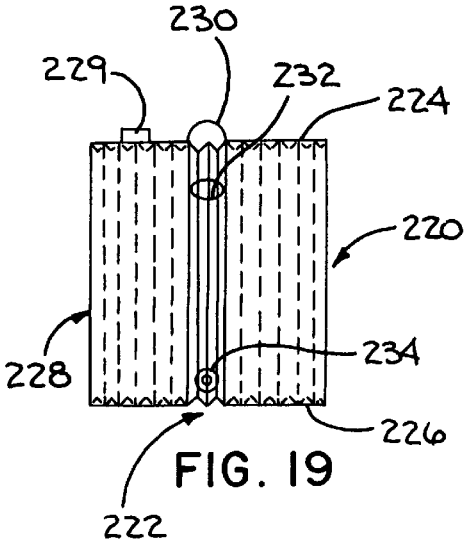
FIG. 19 is a front elevation view of a drum container, according to the present invention.

In FIG. 19, the invention is incorporated into a drum container 220. The drum container 220 has fold structure at 222 in the form of accordion folds extending continuously through 360° over a top wall 224, bottom wall 226, and peripheral wall 228 therebetween. A cap 229 is offset from the accordion folds. The drum 220 could be any size ranging from several ounces to conventional 45 or 55 gallon capacity, or even greater. The fold structure 222 may include accordion folds as shown in phantom lines over substantially the entire peripheral wall 228 to facilitate a more compact collapsing of the drum container.

This construction, when used on high volume (1000's of gallons) containers, allows the containers to be collapsed, as for introduction into tight areas, after which the containers can be expanded to full size. This may obviate reconfiguration of an edifice around the container.

A lifting loop 230 can be provided on the top wall 224 on the fold structure 222. Handles or openings 232 may be located in the raised portions of the accordian folds to facilitate lifting and transportation of the drum container 220. The handles/openings 232 can be molded directly into the drum container 220.

A bung opening 234 can be provided on or in between accordion surfaces to mount spigots or other valves.

Figure 20:
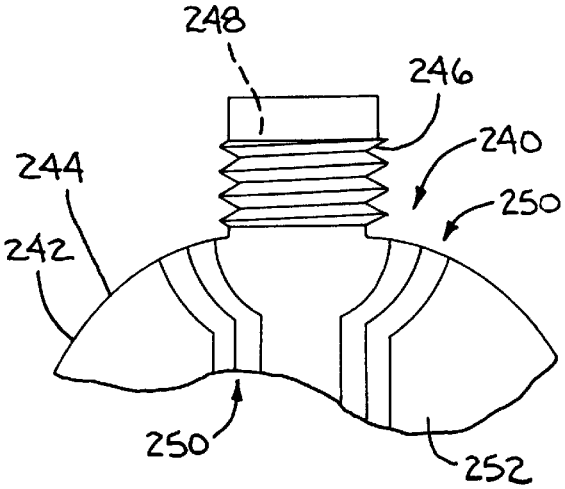
FIG. 20 is a fragmentary, elevation view of a still further modified form of container according to the present invention.

In FIG. 20, a further modified form of container is shown at 240 having a body 242 with a top wall 244 with a neck 246 thereon and an opening 248 through the neck 246. Fold line structure at 250 extends vertically along the peripheral wall 252 of the body 242 and has a non-straight path that curves around the neck 246. This allows collapse of the body 242 around the neck 246 without having to offset the neck 246 from the fold line structure 250, as shown in FIG. 1. The fold line structure 250 may extend continuously to and over a bottom wall (not shown) to permit a compact collapsing to occur.

In each embodiment, the flexibility at the fold lines can be enhanced by scoring continuously or in the form of serration. Alternatively, a reduced thickness can be provided at the fold lines through the molding process. The fold lines can be extended over substantially the entirety of the peripheral surface of each container to facilitate collapse thereof to a compact state continuously through 360° around the top, bottom and peripheral walls.

While the invention performs well with shape-retentive container materials, the invention contemplates making the containers from any material that is not shape-retentive, such as aluminum or other metal. Non-shape retentive material such as paper, cloth, composites, etc. could also be used. With these materials, reconfiguration is facilitated by the present invention to a permanently collapsed state. Combinations of shape-retentive and non-shape retentive materials are also contemplated. The non-shape retentive materials allow for compact collapsing of the containers as for ecologically effective disposal. Using the shape-retentive materials, this same collapsed state can be maintained, such as with the container 10, by tightening the cap 21 in place with the container 10 collapsed. The container can then either be disposed of or re-pressurized to allow filling to its expanded capacity for re-use.

By facilitating reconfiguration of containers, the invention makes everyday use of products potentially easier for children, handicapped persons, or persons with arthritis and allows these same persons to potentially relatively easily compact the container for disposal after use.

The invention permits other products, such as caulking, to be discharged without the need for a separate tool, such as a dispensing "gun" as is commonly used with caulking. This is a convenience and results in a cost saving to the consumer.

The expandable nature of the container allows it to be partially collapsed when filled so as to occupy less space. Volatile materials and highly expandable materials are allowed to expand and contract without unduly stressing the container.

The invention has a potentially universal use, such as in aircraft, ships, automobiles, above ground, in-ground, and underwater tanks.

The foregoing disclosure of specific embodiments is intended to be illustrative of the broad concepts comprehended by the invention.

I claim:

1. A container for holding and facilitating dispensing of a substance, said container comprising:

a body having a peripheral wall defining a storage space for a substance and an opening in communication with the storage space to facilitate introduction of a substance into the storage space and dispensing of a substance from the storage space, said body having a top and bottom, a top wall, a bottom wall, a vertically extending center line, and oppositely facing first and second surfaces on the peripheral wall between the top and bottom of the body and oppositely facing third and fourth surfaces on the peripheral wall between the top and bottom of the body, the first surface having a horizontal center residing between the third and fourth surfaces, the second surface having a horizontal center residing between the third and fourth surfaces, the first, second, third and fourth surfaces being viewable in succession from a first line perpendicular to a second line extending between the top and bottom of the body by turning the body around the vertically extending center line in 90° increments, there being a fold structure on the body that causes a part of the body to reposition in a predetermined manner relative to another part of the body as an incident of a captive force being exerted on the oppositely facing wall surfaces, said fold structure comprising a plurality of fold lines that extend along each of the first and second surfaces substantially fully between the top and bottom of the body and over the bottom wall substantially continuously between the first and second surfaces, the fold lines on the first and second surfaces and top and bottom walls defining accordion folds, the first and second surfaces having a width dimension taken transversely to the second line, the accordion folds occupying substantially less than the width dimension of the first and second surfaces and located at the horizontal centers on both the first and second surfaces, there being a substantial portion of the first surface that has no accordion folds between the accordion folds at the horizontal center of the first surface and the third surface.

2. The container according to claim 1 further comprising a cap that is removably connected to the body to selectively block the body opening.

3. The container according to claim 1 wherein the fold lines extend over the bottom wall substantially fully between the third and fourth surfaces.

4. The container according to claim 1 wherein the peripheral wall has an outer surface that has at least one of a) a cylindrical outline, b) an elliptical outline, and c) an oval outline in cross-section.

5. The container according to claim 4 wherein the at least one of the accordion folds project outwardly from the outline of the peripheral wall.

6. The container according to claim 1 wherein the body is made from a shape-retentive material, the body having an undeformed state and a deformed state which the body is in with the predetermined captive force applied and the body substantially assumes the undeformed state after the predetermined captive force is removed.

7. The container according to claim 1 wherein the body is formed as one piece.

8. The container according to claim 1 wherein the fold lines extend continuously over the top wall between the first and second surfaces and the opening is spaced from the fold line.

9. The container according to claim 1 wherein there are no fold lines on the third surface.

10. The container according to claim 1 wherein there are no fold lines on either of the third and fourth surfaces.

11. A container for holding and facilitating dispensing of a substance, said container comprising:

a body having a peripheral wall defining a storage space for a substance and an opening in communication with the storage space to facilitate introduction of a substance into the storage space and dispensing of a substance from the storage space, said body having a top and bottom, a top wall, a bottom wall, a vertically extending center line, and oppositely facing first and second surfaces on the peripheral wall between the top and bottom of the body and oppositely facing third and fourth surfaces on the peripheral wall between the top and bottom of the body, the first surface having a horizontal center residing between the third and fourth surfaces, the second surface having a horizontal center residing between the third and fourth surfaces, the first, second, third and fourth surfaces being viewable in succession from a first line perpendicular to a second line extending between the top and bottom of the body by turning the body around the vertically extending center line in 90° increments there being a fold structure on the body that causes a part of the body to reposition in a predetermined manner relative to another part of the body as an incident of a captive force being exerted on the oppositely facing wall surfaces, said fold structure comprising a plurality of fold lines that extend along each of the first and second surfaces substantially fully between the top and bottom of the body and over the bottom wall substantially continuously between the first and second surfaces, the fold lines on the first and second surfaces and top and bottom walls defining accordion folds, the first and second surfaces having a width dimension taken transversely to the second line, the accordion folds occupying substantially less than the width dimension of the first and second surfaces, wherein the fold lines extend continuously over the top wall between the first and second surfaces and the opening is spaced from the fold line, wherein the opening is in the top wall and the accordion folds on the top wall are non-straight on the top wall to extend around the opening.

12. A container for holding and facilitating dispensing of a substance, said container comprising:

a body having a peripheral wall defining an internal space, said body having a top and bottom and oppositely facing wall surfaces between the top and bottom of the body, there being a fold line having a first portion extending between the top and bottom of the body that causes a part of the body to reposition in a predetermined manner relative to another part of the body as an incident of a captive force being exerted on the oppositely facing wall surfaces, the body having an outer wall defining an exposed surface of the container; and a peripheral inner wall defining a storage space within the internal space and an opening in communication with the storage space to facilitate introduction of a substance within the storage space and dispensing of a substance from the storage space, the peripheral inner wall having a first circumference and the outer wall having a second circumference.

13. The container according to claim 12, wherein the fold line has a second portion that extends between the top and bottom of the body at a location diametrically opposed to a location at which the first fold line portion is located.

14. The container according to claim 13 wherein the first and second fold line portions are each elongate and extend in a vertical direction.

15. The container according to claim 13 wherein the body is shape-retentive, said body having an undeformed state and a deformed state which the body is in with the predetermined captive force is applied and the body substantially assumes the undeformed state after the predetermined captive force is removed.

* * * * *